US011231168B2

(12) United States Patent
Huang et al.

(10) Patent No.: US 11,231,168 B2
(45) Date of Patent: Jan. 25, 2022

(54) LAMPSTAND WITH SELF-EXTINGUISHING FUNCTION

(71) Applicants: Guozeng Huang, Guangdong (CN); Chao Li, Guangdong (CN)

(72) Inventors: Guozeng Huang, Guangdong (CN); Chao Li, Guangdong (CN)

( * ) Notice: Subject to any disclaimer, the term of this patent is extended or adjusted under 35 U.S.C. 154(b) by 45 days.

(21) Appl. No.: 16/870,123

(22) Filed: May 8, 2020

(65) Prior Publication Data

US 2020/0263865 A1 Aug. 20, 2020

(30) Foreign Application Priority Data

Apr. 8, 2020 (CN) ..... 202010273018.4

(51) Int. Cl.
*F21V 25/00* (2006.01)
*F21V 35/00* (2006.01)
*F21S 13/12* (2006.01)

(52) U.S. Cl.
CPC ..... *F21V 25/00* (2013.01); *F21V 35/00* (2013.01); *F21S 13/12* (2013.01)

(58) Field of Classification Search
CPC ..... F21V 25/00; F21V 25/06; F21V 35/00; F21S 13/12
See application file for complete search history.

(56) References Cited

U.S. PATENT DOCUMENTS

| | | | | |
|---|---|---|---|---|
| 4,102,323 | A * | 7/1978 | Pritz | A47J 36/26 126/260 |
| 6,220,855 | B1 * | 4/2001 | Asheim | F21V 33/00 431/294 |
| 6,572,365 | B1 * | 6/2003 | Byxbe | F23Q 25/00 431/289 |
| 9,585,980 | B1 * | 3/2017 | Li | F21S 6/001 |
| 10,156,357 | B2 * | 12/2018 | Simpson | F23Q 25/00 |
| 10,544,938 | B2 * | 1/2020 | Gaudioso | F23N 5/20 |
| 2005/0188853 | A1 * | 9/2005 | Scannell | A01G 9/02 96/417 |
| 2008/0076082 | A1 * | 3/2008 | Wolfson | F23Q 25/00 431/145 |
| 2018/0252409 | A1 * | 9/2018 | Wyatt | F23D 3/26 |
| 2018/0339079 | A1 * | 11/2018 | Li | A61L 9/032 |
| 2020/0049348 | A1 * | 2/2020 | Butler | B65D 43/26 |

FOREIGN PATENT DOCUMENTS

| | | | | |
|---|---|---|---|---|
| CN | 205504921 | * 10/2016 | | F21V 35/00 |

OTHER PUBLICATIONS

English Machine Translation provided by Google Patents (Year: 2016).*

* cited by examiner

*Primary Examiner* — Zheng Song
(74) *Attorney, Agent, or Firm* — Shimokaji IP

(57) ABSTRACT

A lampstand with self-extinguishing function includes a support bracket, a flame holder, and an extinguishing device. The flame holder is disposed on the support bracket, and the extinguishing device is installed on the support bracket and located above the flame holder to extinguish a flame on the flame holder. Thus, the lampstand can blow the burning flame out thereby avoiding long-term burning, reducing fire risk and improving safety in use.

15 Claims, 5 Drawing Sheets

LAMPSTAND WITH SELF-EXTINGUISHING FUNCTION

RELATED APPLICATIONS

This application claims the benefits of Chinese Patent Application No. 202010273018.4, filed on Apr. 8, 2020, which is hereby incorporated by reference in this application.

FIELD OF THE INVENTION

The present invention relates to a lampstand, and more particularly to a lampstand with self-extinguishing function.

BACKGROUND OF THE INVENTION

An imitation candle lamp is a kind of lamp that imitates the real flame burning effect, and it can create a specific atmosphere and visual effect. However, this imitating flame does not produce visual effect of jumping and blinking like real flames, and there is also a big difference from the atmosphere created by actual flames. However, real flames such as candles and oil lamps are not stable when used in indoor places. When left unattended, they are not extinguished until the fuel is used up. They cannot be automatically extinguished. It is too long to burn and wastes fuel. When they are overturned by accidental touch, it is easy to ignite surrounding objects and cause fire accidents; or it is easy to burn the skin when touched by children, so it is not safe to use.

SUMMARY OF THE INVENTION

Objective of the present invention is to provide a lampstand that is able to blow out the flame burning on the lampstand and improve the safety of use.

To achieve the mentioned above objective, a lampstand with self-extinguishing function is provided, which includes a support bracket, a flame holder, and an extinguishing device. The flame holder is disposed on the support bracket, and the extinguishing device is installed on the support bracket and located above the flame holder to extinguish a flame on the flame holder.

In comparison with the prior art, by providing an extinguishing device on the support bracket, the extinguishing device is located above the flame holder, and the extinguishing device can blow the burning flame on the flame holder. Thus, the burning flame can be blown out thereby extinguishing the flame and avoiding long-term burning, which reduces fire risk and improves safety in use.

Preferably, the extinguishing device is movable relatively to the flame holder. In this way, the extinguishing device will be moved away when the flame is burning, so as to prevent the flame from burning out the extinguishing device; while blowing, the extinguishing device will be moved above the flame holder and then blow the flame out at the shortest distance to ensure that the flame is easily extinguished.

Preferably, the extinguishing device is movable in the horizontal direction.

Preferably, the lampstand further includes a movable arm, and the extinguishing device is movably disposed on the support bracket by the movable arm, so that the extinguishing device is selectively faced or deviated from the flame holder. The movable arm can drive the extinguishing device to move, ensuring that the extinguishing device supports stable and moves accurately and reliably.

Preferably, one end of the movable arm is pivotally connected to the support bracket, and the extinguishing device is fixed to the other end of the movable arm.

Preferably, an upper end of the support bracket is provided with a first limit portion and a second limit portion that limit the movable arm, and a movable groove for the movable arm to move is opened between the first limit portion and the second limit portion. The first limit portion and the second limit portion are provided to limit a rotation stroke of the movable arm, so as to avoid excessive rotation of the movable arm and ensure the extinguishing device move accurately.

Preferably, the extinguishing device includes a motor and fan blades, and an output end of the motor is disposed downward and connected to the fan blades. The motor drives the fan blades, which quickly produces wind, and the extinguishing device has a simple structure and it is convenient to control.

Preferably, the lampstand further includes a tray which is arranged on the flame holder. The tray is used to carry fuel and collect spilled fuel to prevent fuel from flowing onto and around the flame holder.

Preferably, the lampstand further includes an electrostatic precipitator which is disposed on one side of the flame holder. As the fuel burns, it will produce toxic substances and tiny particles floating in the air, which damage human health. Therefore, the electrostatic precipitator will collect these toxic substances and tiny particles in time to purify air.

Preferably, the electrostatic precipitator includes a negative ion generator, and the tray is a conductive tray. Specifically, positive electrode of the negative ion generator is connected to a high potential, and negative electrode is grounded. The ground electrode of the negative ion generator is electrically connected to the conductive tray, and a negative high voltage output end of the negative ion generator is disposed on the support bracket and located on one side of the flame holder.

Preferably, the tray is provided with a positioning structure capable of positioning a lamp body carried on the tray.

Preferably, the positioning structure includes a positioning member and an adjusting member to clamp the lamp body, the positioning member is disposed inside the tray, and the adjusting member is disposed adjustably on the tray. The positioning member and the adjusting member can quickly and conveniently fix the lamp body, prevent accidental overturning, and improve the safety in use.

Preferably, the lampstand further includes a control circuit board and a power source, and the extinguishing device and the power source are electrically connected to the control circuit board, respectively. The control circuit board can control the extinguishing device to automatically blow out the flame.

Preferably, the lampstand further includes a first detector which is arranged in the support bracket or the flame holder and is electrically connected to the control circuit board. The first detector detects whether the support bracket and the flame holder falls down at any time, so that the extinguishing device blows out the flame in time, improving safety in use.

Preferably, the lampstand further includes a human body sensor, which is arranged in the support bracket or the flame holder and electrically connected to the control circuit board. The human body sensor can detect whether there is a person at a certain distance around the support bracket and the flame holder at any time. When a person approaches, the extinguishing device blows out the flame in time to avoid burns and improve the safety in use.

Preferably, the lampstand further includes a timer that is electrically connected to the control circuit board. The timer sets time according to the user's needs. When the set time is reached, the extinguishing device is controlled by the control circuit board to blow out the flame, which not only saves fuel, but also avoids burning unattended for a long time, and improves the safety of use.

Preferably, the lampstand further includes a remote controller and a receiver, the receiver is electrically connected to the control circuit board, and the remote controller is communicated with the receiver. The remote controller and the receiver realize long-distance operation and improve convenience of use.

BRIEF DESCRIPTION OF THE DRAWINGS

The accompanying drawings facilitate an understanding of the various embodiments of this invention. In such drawings.

DETAILED DESCRIPTION OF ILLUSTRATED EMBODIMENTS

Figure 1:
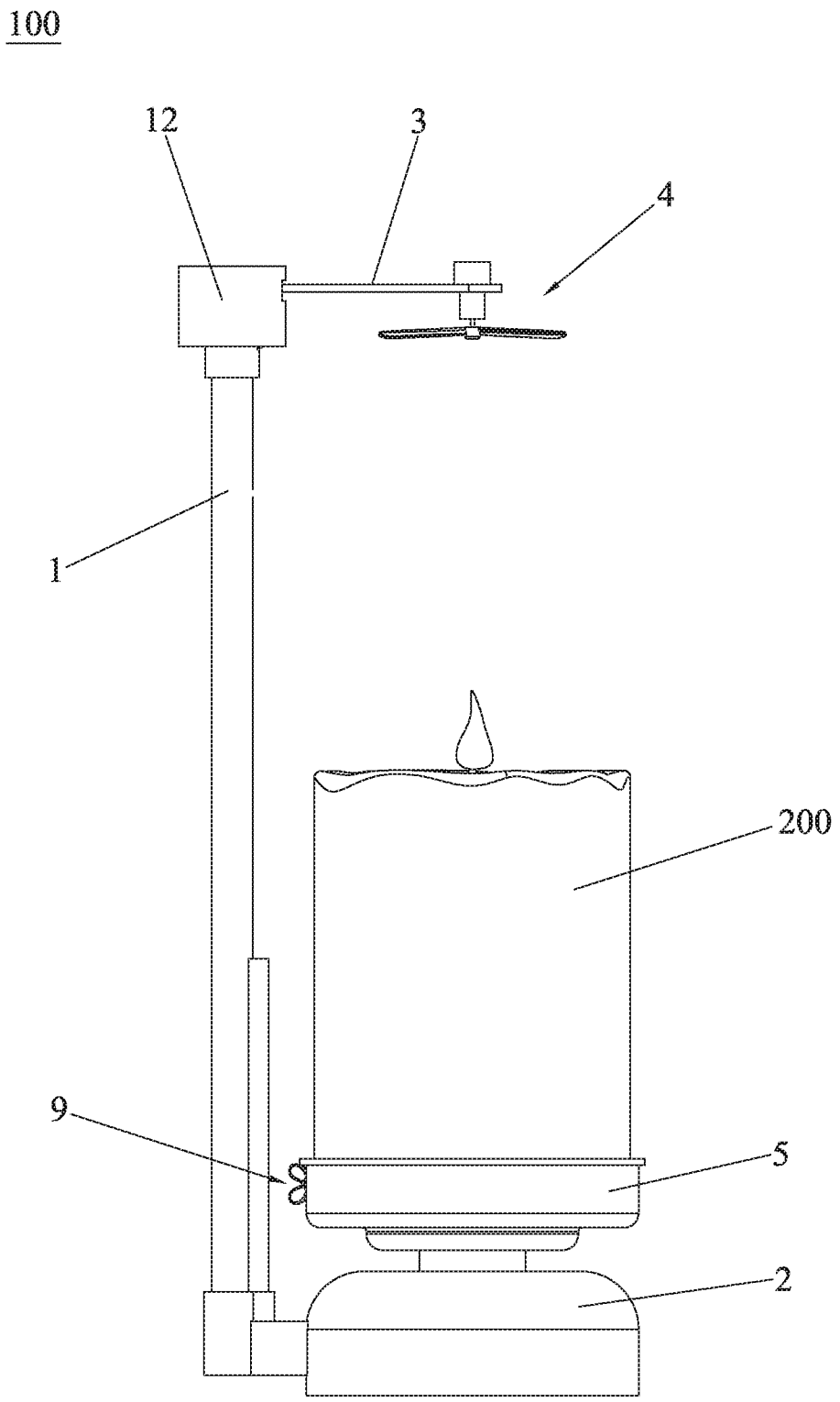
FIG. 1 is a front view of a lampstand according to an embodiment of the present invention.

A distinct and full description of the technical solution of the present invention will follow by combining with the accompanying drawings.

As illustrated in FIGS. 1-4, a lampstand 100 with self-extinguishing function includes a support bracket 1, a flame holder 2, a movable arm 3, an extinguishing device 4, a tray 5, a control circuit board 6, and a power source 7. The flame holder 2 is fixedly disposed at a lower end of the support bracket 1, the support bracket 1 has a tubular structure, and the support bracket 1 is vertically disposed. The extinguishing device 4 is movably disposed on the support bracket 1 by the movable arm 3 and located above the flame holder 2 so that the extinguishing device 4 faces the flame holder 2 to blow the flame out on the flame holder 2.

Specifically, the movable arm 3 drives the extinguishing device 4 to move in a horizontal direction relatively to the flame holder 2. The movable arm 3 is disposed horizontally. One end of the movable arm 3 is pivotally connected to the support bracket 1 through a pivot shaft 11 at an upper end of the support bracket 1, and the extinguishing device 4 is fixed to the other end of the movable arm 3. The movable arm 3 ensures that the extinguishing device 4 supports stable and moves accurately and reliably. In this way, the extinguishing device 4 will be moved away while the flame is burning, thereby preventing the flame from burning out the extinguishing device 4; when to blow, the extinguishing device 4 will be moved above the flame holder 2 and then blow the flame out at the shortest distance to ensure that the flame is easily extinguished. Preferably, the tray 5 is disposed on the flame holder 2 and used to carry fuel and collect spilled fuel to prevent fuel from flowing onto and around the flame holder 2. In this embodiment, the fuel is solid wax oil, such as a candle, and the candle is placed on the tray 5. Of course, it can also be a kerosene lamp. The control circuit board 6 and the power source 7 is set in the flame holder 2, and the extinguishing device 4 and the power source 7 are electrically connected to the control circuit board 6, respectively. The control circuit board 6 can control the extinguishing device 4 to automatically blow out the flame.

Referring to FIGS. 1 to 3 again, specifically, a mounting base 12 is provided on the upper end of the support bracket 1, and the pivot shaft 11 is installed in the mounting base 12. One end of the movable arm 3 is provided with a movable sleeve 31, and the movable sleeve 31 is sleeved on the pivot shaft 11. A side surface of the mounting base 12 is provided with a first limit portion 121 and a second limit portion 122 for limiting the movable arm 3. A movable groove for the movable arm 3 to move is opened between the first limit portion 121 and the second limit portion 122. In this embodiment, a rotation angle of the movable arm 3 between the first limit portion 121 and the second limit portion 122 is 90 degrees. The first limit portion 121 and the second limit portion 122 are provided to limit a rotation stroke of the movable arm 3, so as to avoid excessive rotation of the movable arm 3 and ensure the extinguishing device 4 move accurately.

Referring to FIGS. 1 and 2 again, the extinguishing device 4 includes a motor 41 and fan blades 42, and an output end of the motor 41 is disposed downward and connected to the fan blades 42. The motor 41 is connected to a switching circuit 61 through a wire inside the movable arm 3 and the support bracket 1, and then connected to the control circuit board 6. Specifically, the control circuit board 6 controls start and stop of the motor 41 and positive and negative rotation of an output end of the motor 41. The motor 41 drives the fan blades 42 to quickly produce wind, and the extinguishing device 4 has a simple structure and convenient control.

Moreover, because the fan blades 42 are tilted, when the motor 41 rotates forward to drive the fan blades 42 to rotate and blow down, the wind will exert a thrust on the fan blades 42, which will produce a horizontal component force. This component force can push the movable arm 3 to rotate, so that the movable arm 3 drives the extinguishing device 4 to move directly above the flame holder 2. Conversely, when the motor 41 rotates in reverse to drive the fan blades 42 to rotate in reverse, a reverse component force is generated, thereby pushing the movable arm 3 to rotate reversely. Thus, the movable arm 3 drives the extinguishing device 4 to move and leave directly above the flame holder 2. Therefore, the motor 41 and the wind blades 42 can produce the wind for extinguishing the flame, and can also be used as the power for the movable arm 3 to move, simplifying the structure.

Preferably, the lampstand 100 further includes an electrostatic precipitator 8 which is disposed on one side of the flame holder 2. Specifically, the electrostatic precipitator 8 includes a negative ion generator 81, and the tray 5 is a conductive tray made of metal. Specifically, positive electrode of the negative ion generator 81 is connected to a high potential, and negative electrode is grounded. The ground electrode of the negative ion generator 81 is electrically connected to the conductive tray, and the negative high voltage output end of the negative ion generator 81 is disposed on the support bracket 1 and located on one side of the flame holder 2. As the fuel burns, it will produce toxic substances and tiny particles floating in the air, which damages human health. Therefore, the electrostatic precipitator 8 will collects these toxic substances and tiny particles in time to purify air.

Figure 2:
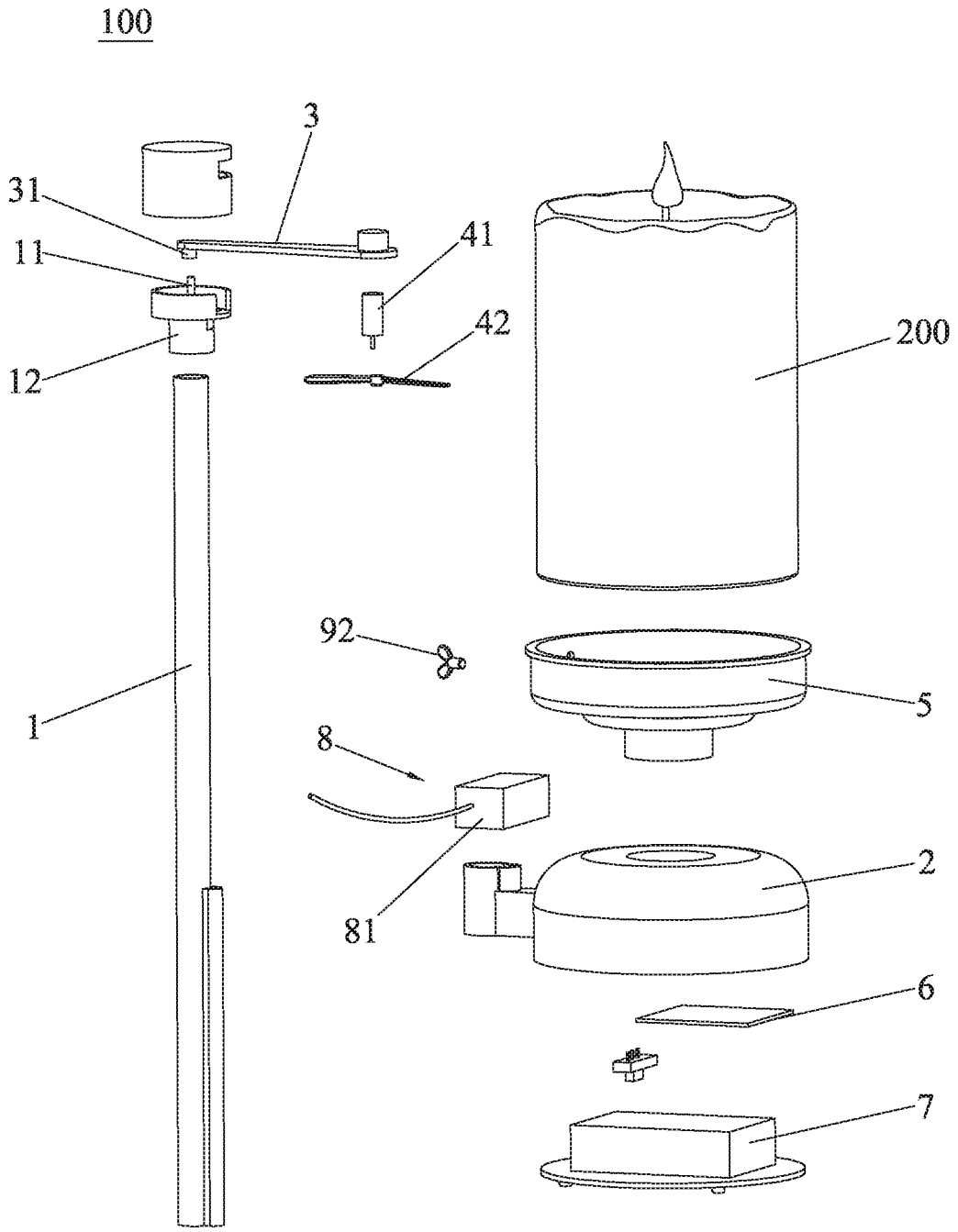
FIG. 2 is an exploded view of a lampstand according to an embodiment of the present invention.
Figure 5:
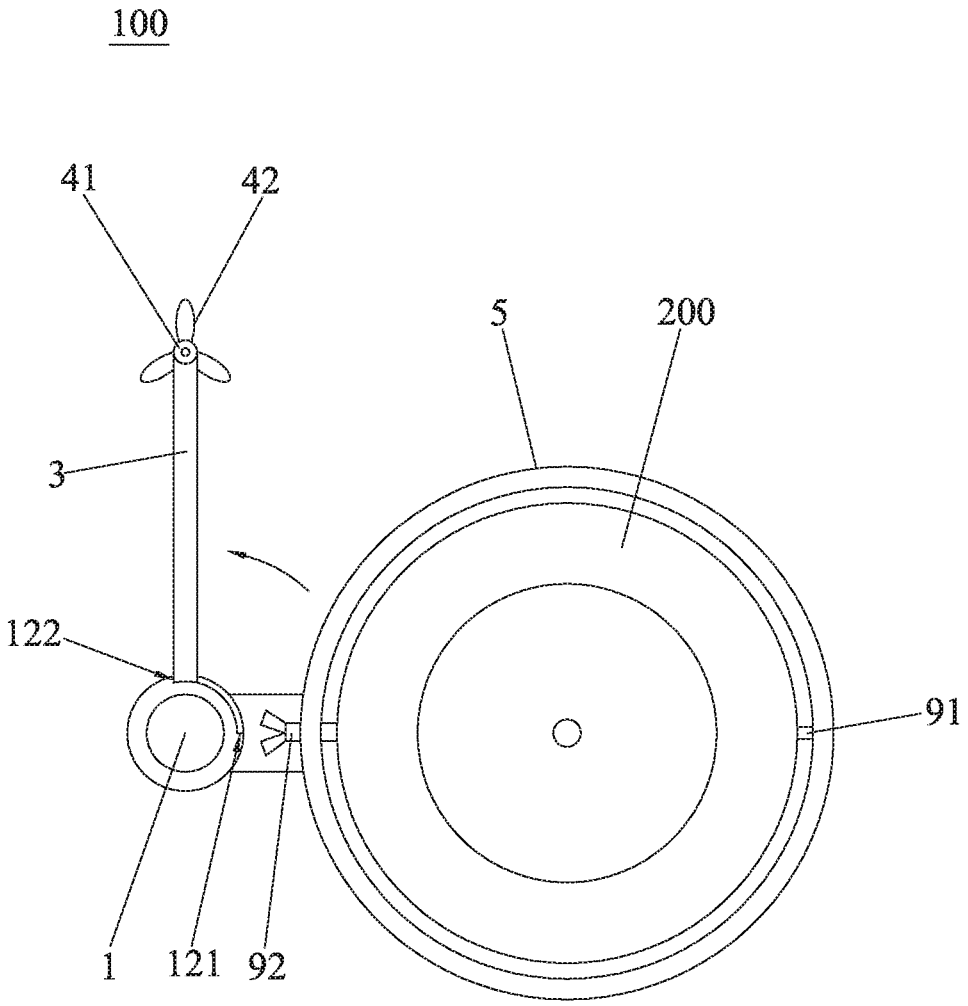
FIG. 5 is a plan view of the lampstand when the extinguishing device is deviated from the flame holder.

As shown in FIGS. 1-2 and 5, the tray 5 is provided with a positioning structure 9 capable of positioning a lamp body carried on the tray 5. Preferably, the positioning structure 9 includes a positioning member 91 and an adjusting member 92 to clamp the lamp body, the positioning member 91 is disposed inside the tray 5, and the adjusting member 92 is disposed adjustably on the tray 5. The positioning member 91 and the adjusting member 92 can quickly and conveniently fix the lamp body, prevent accidental overturning, and improve the safety in use.

Figure 3:
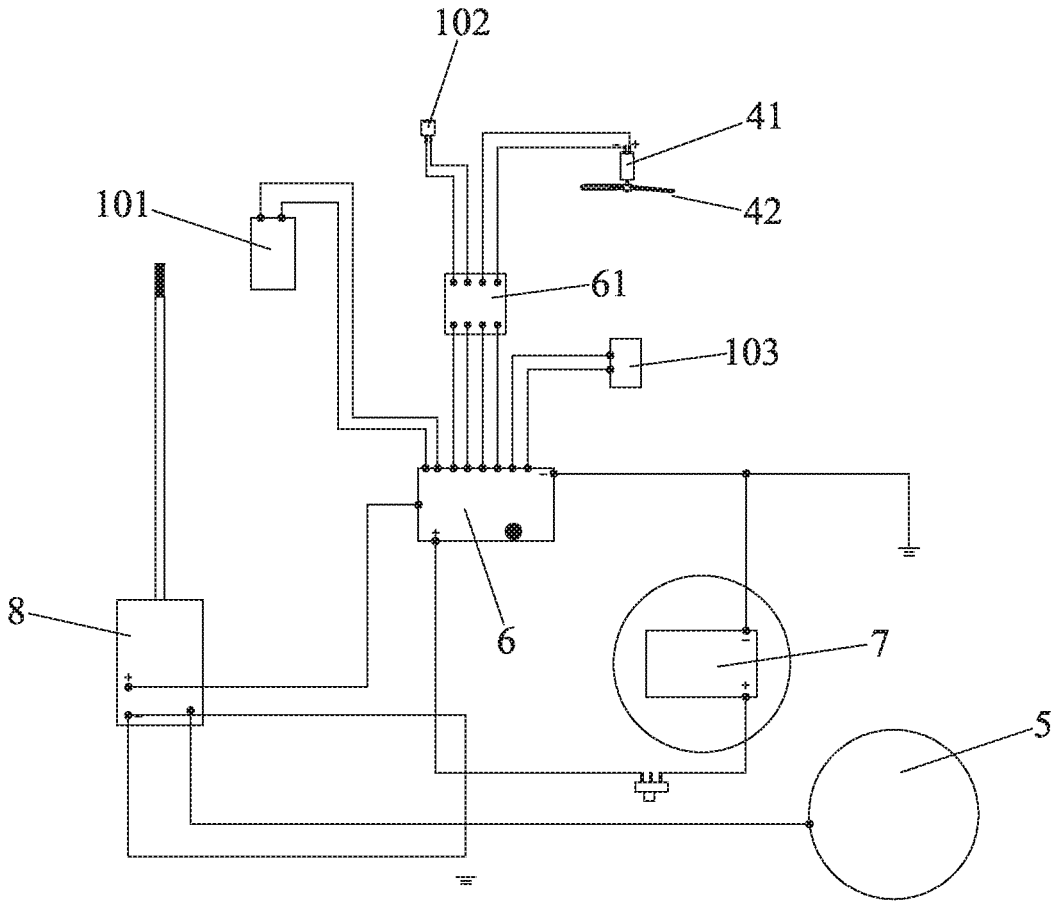
FIG. 3 is a schematic diagram showing a circuit connection of the various elements of the lampstand.

As shown in FIG. 3, the lampstand 100 further includes a first detector 101, a human body sensor 102, and a timer 103. The first detector 101 is arranged in the support bracket 1 or the flame holder 2 and electrically connected to the control circuit board 6 via a switching circuit 61. In this embodiment, the first detector 101 is a vibration detector that can detect whether the support bracket 1 and the flame holder 2 are vibrated or pushed down at any time. When detecting that the support bracket 1 vibrates or is falling down, the vibration detector can control the extinguishing device 4 to move directly above the flame holder 2 by the control circuit board 6 and blow out the flame in time, thereby ensuring that the flame is blown out after lying down and improving safety in use. The human body sensor 102 is arranged in the support bracket 1 or the flame holder 2 and electrically connected to the control circuit board 6. The human body sensor 102 can detect whether there is a person at a certain distance around the support bracket 1 and the flame holder 2 at any time, so that when a person approaches, the extinguishing device 4 blows out the flame in time to avoid burns and improve the safety in use. The timer 103 is an electronic timer and is electrically connected to the control circuit board 6. The timer 103 sets the time according to user's needs, when the set time is reached, the extinguishing device 4 is controlled by the control circuit board 6 to blow out the flame, which not only saves fuel, but also avoids burning unattended for a long time, improving the safety of use.

Preferably, the lampstand 100 further includes a remote controller and a receiver (not shown in Figure), the receiver is electrically connected to the control circuit board 6, and the remote controller is communicated with the receiver. The remote controller and the receiver realize a long-distance operation and improve the convenience of use.

Figure 4:
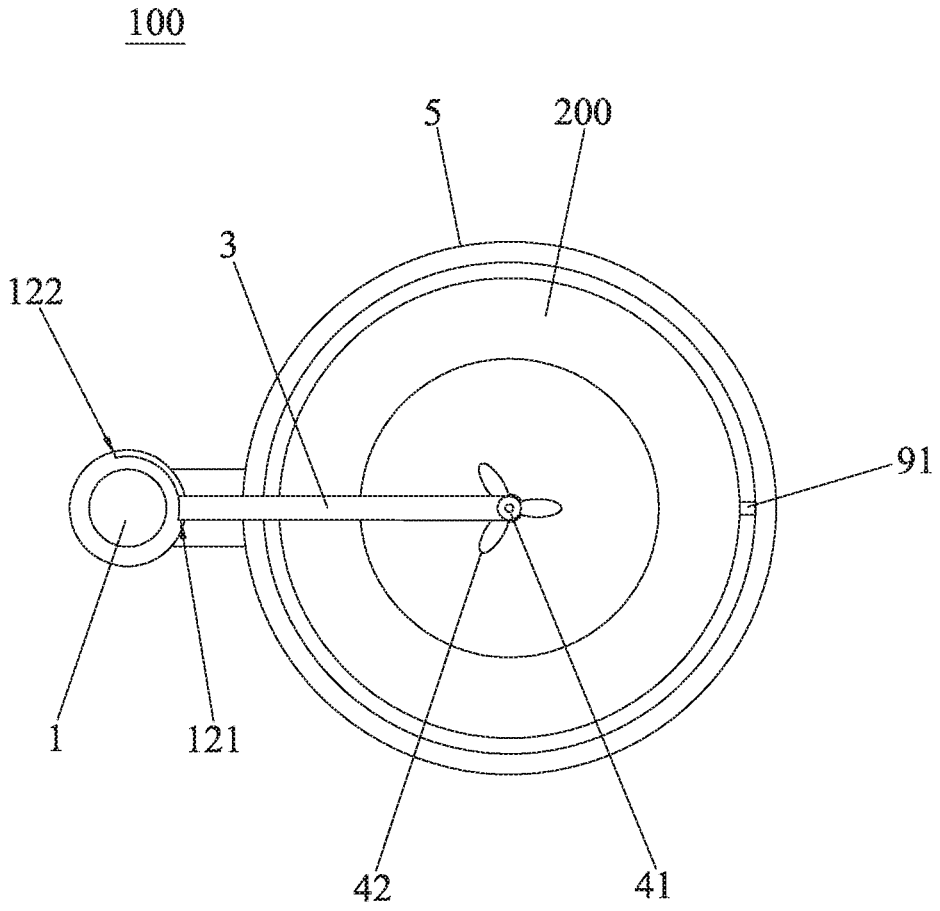
FIG. 4 is a plan view of the lampstand when an extinguishing device is located directly above a flame holder.

Referring to FIGS. 1, 4 and 5, taking the candle lamp 200 as an example, working principle of the lampstand 100 will be described in detail, as follows:

The candle lamp 200 is placed on the tray 5 and fixed by the positioning structure 9, then the candle lamp 200 is lit and burns. When it is necessary to purify the air, the electrostatic precipitator 8 is started to work through the remote controller, so that smoke is eliminated. When the candle lamp 200 needs to be extinguished, the remote controller controls the motor 41 to rotate in forward direction, and the wind blades 42 produce wind. At the same time, the horizontal force generated by the wind blades 42 pushes the movable arm 3 to rotate. The movable arm 3 drives the extinguishing device 4 to move directly above the candle lamp 200, and the flame from the candle lamp 200 will be blown out. It takes about 2 seconds for the extinguishing device 4 to start to blow out the flame. When the flame is blown out, the extinguishing device 4 stops for 1 second under the control of the control circuit, and then the motor 41 rotates inversely. Subsequently, the wind blades 42 rotate in reverse, and the horizontal component force generated by the wind blades 42 pushes the movable arm 3 to rotate inversely, and the movable arm 3 drives the extinguishing device 4 to move away from the candle lamp 200. After the motor 41 is reversed for 2 seconds, the control circuit controls the motor 41 to stop and controls the electrostatic precipitator 8 to stop working.

When the candle lamp 200 needs to be extinguished by setting the time, the timer 103 needs to be set. When the time is reached, the control circuit can control the motor 41 to start to extinguish the flame. The working principle is similar as above and will not be repeated.

In comparison with the prior art, by providing an extinguishing device 4 on the support bracket 1, the extinguishing device 4 is located above the flame holder 2, and the extinguishing device 4 can blow the burning flame on the flame holder 2. And by setting the timer 103 and the control circuit board 6, the timer 103 is used to start the extinguishing device 4 through the control circuit board 6, so the burning flame can be blown out thereby extinguishing the flame and avoiding long-term burning, which reduces fire risk. At the same time, by providing a vibration detector and a human body sensor 102, the flame is extinguished when the lamp body is accidentally lying down or someone approaches, thereby improving safety in use.

Understandably, the vibration detector, the human body sensor 102, and the timer 103 and the control circuit 6 involved in the present invention are well known to those of ordinary skill in the art, and will not be described in detail here.

The foregoing description of the present invention has been presented for purposes of illustration and description. It is not intended to be exhaustive or to limit the invention to the precise form disclosed, and obviously many modifications and variations are possible in light of the above teaching. Such modifications and variations that may be apparent to those skilled in the art are intended to be included within the scope of this invention as defined by the accompanying claims.

What is claimed is:

1. A lampstand with self-extinguishing function, comprising a support bracket, a flame holder, and an extinguishing device, wherein the flame holder is disposed on the support bracket, and the extinguishing device is installed on the support bracket and located above the flame holder to extinguish a flame on the flame holder, the lampstand further comprises a tray which is disposed on the flame holder, the tray is provided with a positioning structure capable of positioning a lamp body carried on the tray, the positioning structure comprises a positioning member and an adjusting member to clamp the lamp body, the positioning member is disposed inside the tray, and the adjusting member is disposed adjustably on the tray.

2. The lampstand with self-extinguishing function according to claim 1, wherein the extinguishing device is movable relatively to the flame holder.

3. The lampstand with self-extinguishing function according to claim 2, wherein the extinguishing device is movable in the horizontal direction.

4. The lampstand with self-extinguishing function according to claim 3, further comprising a movable arm, and the extinguishing device is movably disposed on the support bracket by the movable arm, so that the extinguishing device is selectively faced or deviated from the flame holder.

5. The lampstand with self-extinguishing function according to claim 4, wherein one end of the movable arm is pivotally connected to the support bracket, and the extinguishing device is fixed to the other end of the movable arm.

6. The lampstand with self-extinguishing function according to claim 5, an upper end of the support bracket is provided with a first limit portion and a second limit portion that limit the movable arm, and a movable groove for the movable arm to move is opened between the first limit portion and the second limit portion.

7. The lampstand with self-extinguishing function according to claim 1, further comprising a control circuit board and a power source, and the extinguishing device and the power source are electrically connected to the control circuit board, respectively.

8. The lampstand with self-extinguishing function according to claim 7, further comprising a first detector which is arranged in the support bracket or the flame holder and electrically connected to the control circuit board.

9. The lampstand with self-extinguishing function according to claim 7, further comprising a human body sensor, which is arranged in the support bracket or the flame holder and electrically connected to the control circuit board.

10. The lampstand with self-extinguishing function according to claim 7, further comprising a timer that is electrically connected to the control circuit board.

11. The lampstand with self-extinguishing function according to claim 7, further comprising a remote controller and a receiver, the receiver is electrically connected to the control circuit board, and the remote controller is communicated with the receiver.

12. The lampstand with self-extinguishing function according to claim 1, further comprising an electrostatic precipitator which is disposed on one side of the flame holder.

13. The lampstand with self-extinguishing function according to claim 12, wherein the electrostatic precipitator comprises a negative ion generator, and the tray is a conductive tray; and positive electrode of the negative ion generator is connected to a high potential, negative electrode is grounded, the ground electrode of the negative ion generator is electrically connected to the conductive tray, and a negative high voltage output end of the negative ion generator is disposed on the support bracket and located on one side of the flame holder.

14. The lampstand with self-extinguishing function according to claim 1, wherein the extinguishing device comprises a motor and fan blades, and an output end of the motor is disposed downward and connected to the fan blades.

15. A lampstand with self-extinguishing function, comprising a support bracket, a flame holder, and an extinguishing device, wherein the flame holder is disposed on the support bracket, and the extinguishing device is installed on the support bracket and located above the flame holder to extinguish a flame on the flame holder, the lampstand further comprises a tray disposed on the flame holder and an electrostatic precipitator disposed on one side of the flame holder, the electrostatic precipitator comprises a negative ion generator, and the tray is a conductive tray; and positive electrode of the negative ion generator is connected to a high potential, negative electrode is grounded, the ground electrode of the negative ion generator is electrically connected to the conductive tray, and a negative high voltage output end of the negative ion generator is disposed on the support bracket and located on one side of the flame holder.

* * * * *